US007690733B2

(12) United States Patent
Spitale et al.

(10) Patent No.: US 7,690,733 B2
(45) Date of Patent: Apr. 6, 2010

(54) METHOD FOR TUFTING BRISTLES AND BRUSH USING THE SAME

(75) Inventors: Paul Spitale, Peachtree City, GA (US); Kim V. Peterson, Manchester, GA (US); David Harper, Manchester, GA (US); Tianyi Chang, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 0 days.

(21) Appl. No.: 12/200,453

(22) Filed: Aug. 28, 2008

(65) Prior Publication Data

US 2008/0315670 A1 Dec. 25, 2008

Related U.S. Application Data

(62) Division of application No. 10/807,940, filed on Mar. 24, 2004, now abandoned.

(60) Provisional application No. 60/482,425, filed on Jun. 25, 2003.

(51) Int. Cl.
*A46D 3/00* (2006.01)
*A46B 7/00* (2006.01)

(52) U.S. Cl. ..... 300/21; 15/159.1; 15/191.1; 15/193

(58) Field of Classification Search ..... 15/191.1, 15/192, 193, 159.1; 300/21
See application file for complete search history.

(56) References Cited

U.S. PATENT DOCUMENTS

| | | | | |
|---|---|---|---|---|
| 1,957,363 A | | 5/1934 | Snell | |
| 2,718,024 A | * | 9/1955 | Maynard | 15/186 |
| 4,244,076 A | * | 1/1981 | Meyer | 15/188 |
| 5,352,025 A | * | 10/1994 | Huang | 300/21 |

FOREIGN PATENT DOCUMENTS

| | | |
|---|---|---|
| DE | 809 459 | 7/1951 |
| DE | 3927728 | 2/1991 |
| FR | 2307493 | 11/1976 |
| FR | 2466216 | 4/1981 |

OTHER PUBLICATIONS

Search Report under Section 17(5) date Jun. 29, 2005.

* cited by examiner

*Primary Examiner*—Randall Chin
(74) *Attorney, Agent, or Firm*—Gardner Groff Greenwald & Villanueva PC

(57) ABSTRACT

A hair brush may include a body having a receiving portion at a first end. A cushion pad having an inner surface and an outer surface may be disposed in the receiving portion, and may include a plurality of bristle anchors having an aperture. A plurality of bristles may be tufted into each of the apertures.

22 Claims, 5 Drawing Sheets

METHOD FOR TUFTING BRISTLES AND BRUSH USING THE SAME

RELATED APPLICATION DATA

The present application is a divisional application claiming the priority benefit of U.S. non-provisional application Ser. No. 10/807,940 filed on Mar. 24, 2004, now abandoned which claims the priority benefit of U.S. provisional application Ser. No. 60/482,425 filed on Jun. 25, 2003, the entire scope and content of both of which are expressly incorporated by reference herein.

FIELD OF THE DISCLOSURE

The disclosure relates generally to a method for tufting bristles and brushes using same, and more particularly, to a method for tufting bristles into a cushion of a brush and a cushioned brush.

BACKGROUND OF THE DISCLOSURE

Hair brushes and the tufting of hair brushes are generally known in the art. For example, most standard tufted brushes are manufactured by first drilling holes into a brush frame, and then filling the holes (mechanically) with bristles. The bristles are anchored in the holes and hence the brush frame, by forcing a metal fastener into the holes with the bristles, thereby compressing and anchoring the bristles in the hole. This process results in brush frames that are rigid and that do not deform or deflect to match the contour of the user's head.

Brushes having flexible cushion pads have been developed to flex and/or conform to the user's head during use. Most tufted cushion pads for these brushes on the market today are first fabricated with holes (through injection molding or die cutting) and are then fitted with bristles. The bristles are anchored in the cushion pad with an epoxy or fabric on the back side of the pad. Since the cushion pads are flexible by nature, the bonding of the bristles to the flexible cushion pad is extremely difficult, and results in frequent quality problems.

SUMMARY OF THE DISCLOSURE

In accordance with one aspect of the disclosure, a hair brush a receiving portion at a first end of a body is disclosed. The hair brush further includes a plurality of bristle anchors, a cushion pad, and a plurality of bristles. The bristle anchors are disposed in the cushion pad and each include an aperture. The cushion pad includes an inner surface and an outer surface, and is disposed in the receiving portion. A plurality of bristles is tufted into each of the apertures.

In accordance with another aspect of the disclosure, a hair brush having a receiving portion at a first end of a body is disclosed. The hair brush further includes a plurality of bristle anchors, a cushion pad, and a plurality of bristles. The bristle anchors are disposed in the cushion pad and include a bore, a first end, a second end, and a groove. The groove is disposed between the first end and the second end, and the bore is oriented generally perpendicular to the groove. The cushion pad includes an inner surface, an outer surface, and a plurality of apertures. The cushion pad is disposed in the receiving portion, and the plurality of apertures engages the grooves in the plurality of bristle anchors. A plurality of bristles is tufted into each of the bores.

In accordance with another aspect of the disclosure, a method of tufting bristles is disclosed. The method includes molding a plurality of bristle anchors from a first material, and providing an aperture in each of the bristles anchors. The method further includes molding a cushion pad from a second material, and tufting a plurality of bristles in the apertures.

BRIEF DESCRIPTION OF THE DRAWINGS

The advantages of the present invention will be apparent upon reading the following description in conjunction with the drawings, in which.

Figure 1:
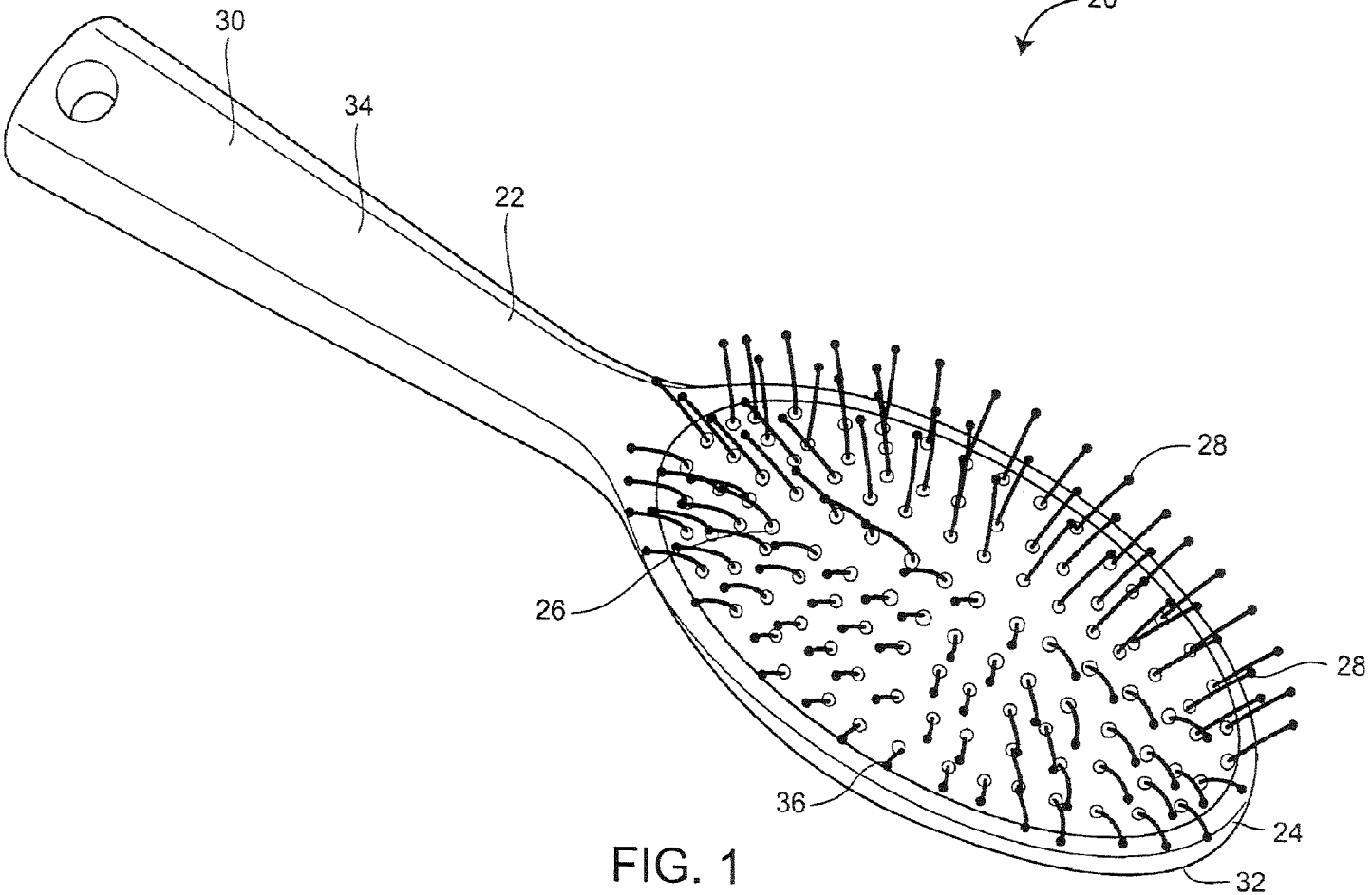
FIG. 1 is a perspective view of one embodiment of a hair brush having a cushion pad with tufted bristles.

While the invention is susceptible to various modifications and alternative constructions, certain illustrative embodiments thereof have been shown in the drawings and will be described below in detail. It should be understood, however, that there is no intention to limit the invention to the specific forms disclosed, but, on the contrary, the intention is to cover all modifications, alternative constructions, and equivalents falling within the spirit and scope of the disclosure.

DETAILED DESCRIPTION

Figure 2:
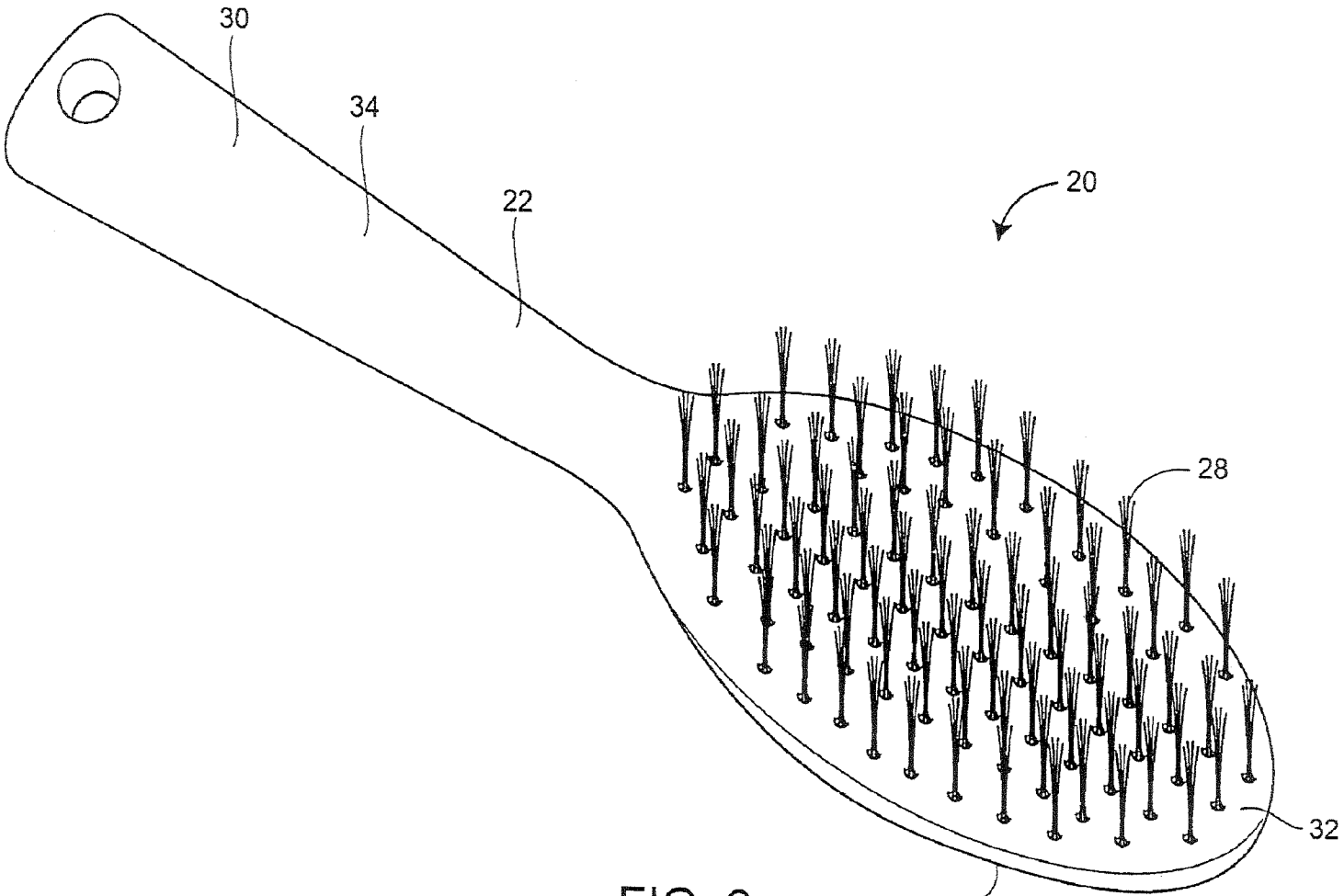
FIG. 2 is a perspective view of another embodiment of a hair brush having a cushion pad with tufted bristles.

Referring now to the drawings, and with specific reference initially to FIG. 1, a hair brush 20 includes a body 22, a cushion pad 24, bristle anchors 26, and a plurality of bristles 28. The hair brush 20, as depicted in FIG. 1, is only one exemplary type of hair brush 20 and, more particularly, one exemplary type of hair brush head that may be used in conjunction with the present disclosure. The hair brush 20 and the cushion pad 24 are, therefore, not limited to the disclosed embodiment as depicted in FIG. 1 and FIG. 2. The hair brush 20, and more particularly the cushion pad 24 as disclosed herein, is constructed from an improved method for tufting bristles 28 to a cushion pad 24 and provides an improved cushion pad 24 with bristles 28 using the method. The cushion pad 24 as shown in FIG. 1 may be located on the brush 20, or as shown in FIG. 2, may be located within the brush 20. The cushion pad 24 is, however, not limited to being disposed within or on the hair brush 20, but may be disposed on or form any portion of the hair brush 20 or any other type of cushioned brush.

In one exemplary embodiment as illustrated in FIG. 1, the brush 20 includes a first end 30 and a second end 32 wherein the first end 30 includes a handle 34 and the second end 32 includes a receiving portion 36 for the cushion pad 24. The receiving portion 36 as shown in FIG. 1 may simply be a recess 36, with the cushion pad 24 being sized and shaped to fit therein. Similarly, as shown in FIG. 2, the receiving portion 36 may be a cavity 36 (not shown) within which the cushion pad 24 resides.

Figure 4:
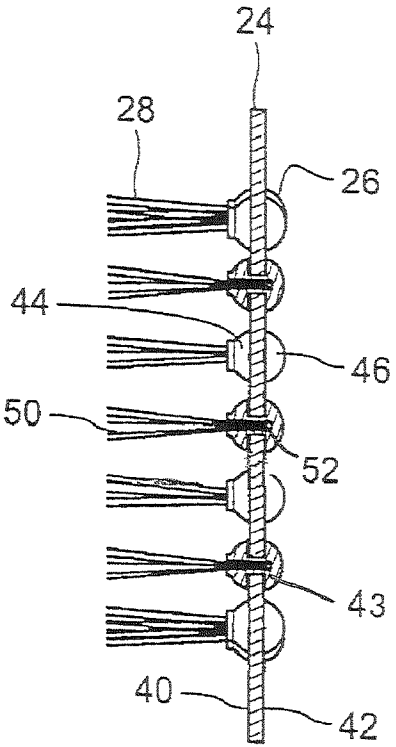
FIG. 4 is a cross-sectional view of the cushion pad having tufted bristles taken along line 4-4 of FIG. 3.
Figure 3:
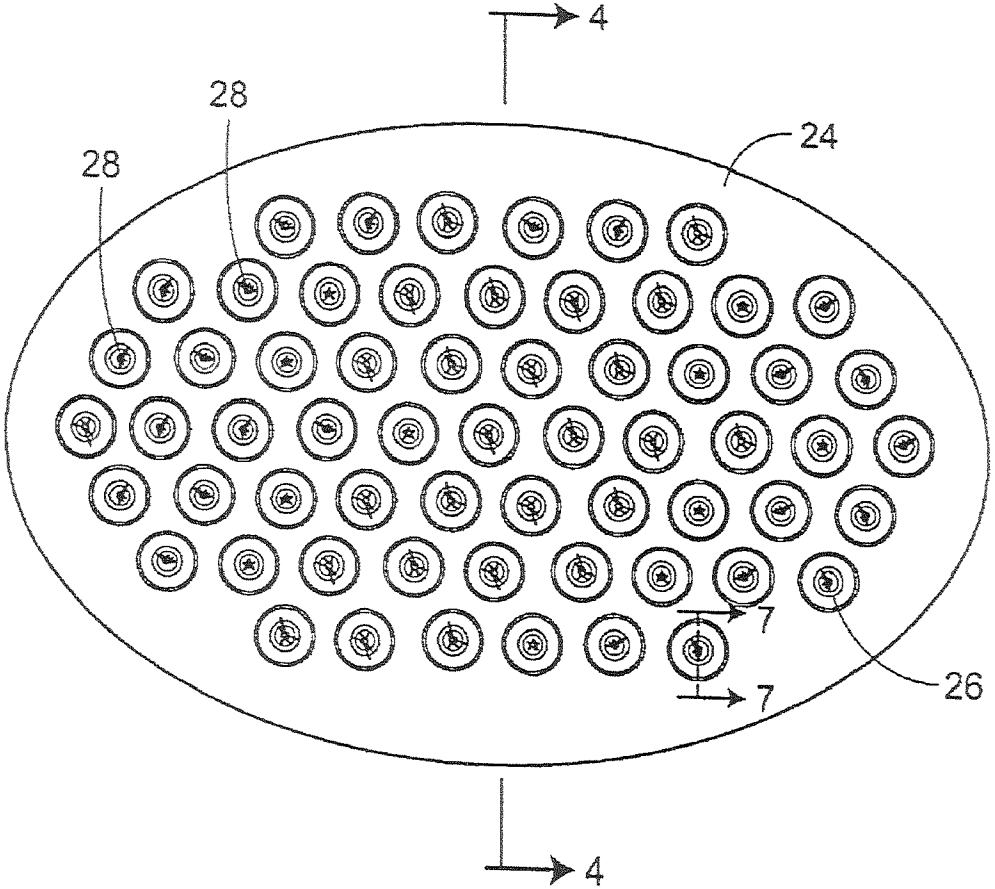
FIG. 3 is a plan view of one embodiment of a cushion pad having tufted bristles.
Figure 6:
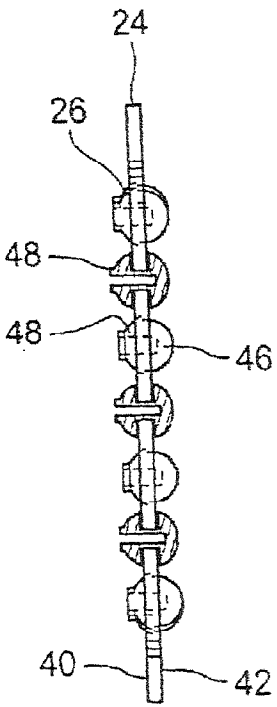
FIG. 6 is a cross-sectional view of the cushion pad without tufted bristles taken along line 6-6 of FIG. 5.
Figure 5:
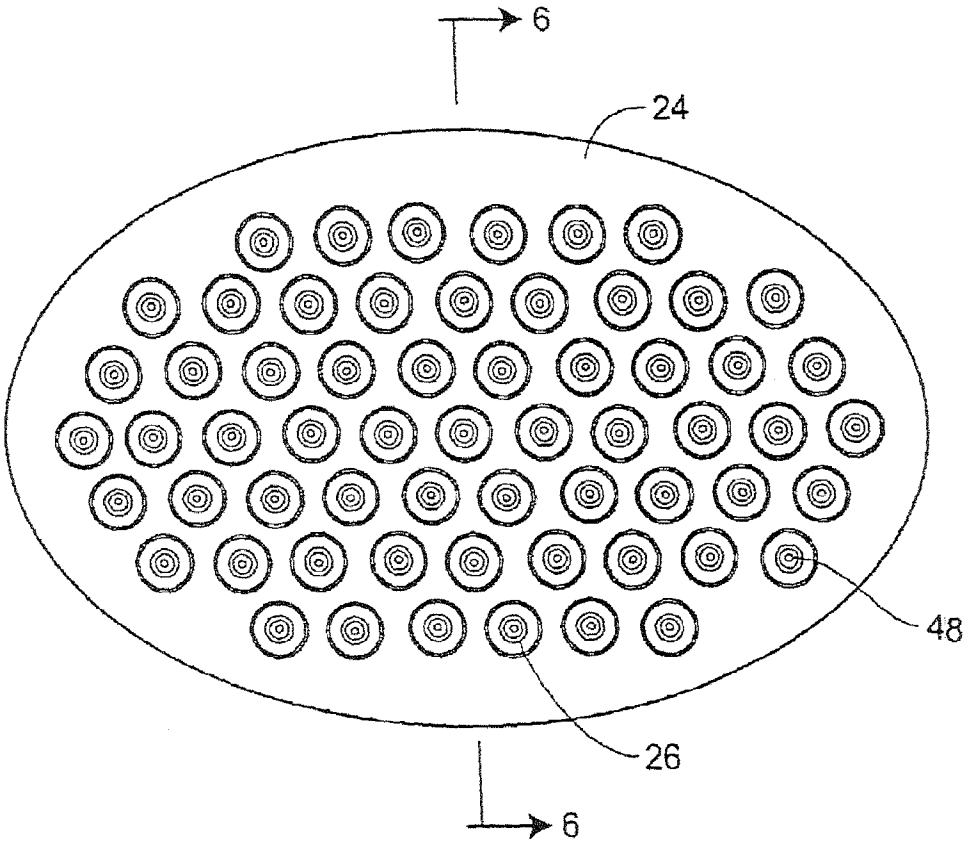
FIG. 5 is a plan view of another embodiment of a cushion pad before the bristles are tufted.

In one exemplary embodiment as shown in FIGS. 3 and 4, the cushion pad 24 includes a first surface 40, a second surface 42, and may include a plurality of apertures 43. The bristles anchors 26 include a first end 44, a second end 46 and an aperture 48 disposed near the first end 44. The plurality of bristles 28 includes a first or free end 50 and a second or attachment end 52. The bristle anchors 26 have a generally spherical shape and are disposed within the cushion pad 24, and more specifically, within the apertures 43 of the cushion pad 24, such that the first end 44 of the bristle anchors 26 extend beyond the first surface 40 of the cushion pad 24 and the second end 46 of the bristle anchors 26 extend beyond the second surface 42 of the cushion pad 24. The apertures 48 of the bristle anchors 26 are disposed near the first end 44 of the bristle anchors 26 and extend inwardly thereto. The second end 52 of the bristles 28 are disposed within the apertures 48 of the bristle anchors 26, such that the first end 50 of the bristles 28 extend outwardly from the bristle anchors 26 and such that the bristles 26 are oriented substantially perpendicular to the cushion pad 24.

In operation, the cushion pad 24 may be tufted with the bristles 28 in a two-step process. First, the bristle anchors 26 may be imbedded into the cushion pad 24 using several techniques and technologies. In one exemplary embodiment, the cushion pad 24 may be injection molded such that the bristle anchors 26 are embedded within the cushion pad 24. For example, the cushion pad 24 may be manufactured using a two-shot injection molding process or an insert molding process. In a first part of such a process, the bristle anchors 26 may be molded first. In a second part of such a process, the cushion pad 24 may be molded around the bristle anchors 26. Depending upon the process, the anchor can either be molded in place and then the pad can be subsequently molded, or the anchors can be molded and then inserted into a second mold for molding the pad. Such a process may promote a covalent bond between a propylene material used for the bristle anchors 26, and the thermoplastic elastomeric used for the cushion pad 24.

Figure 7:
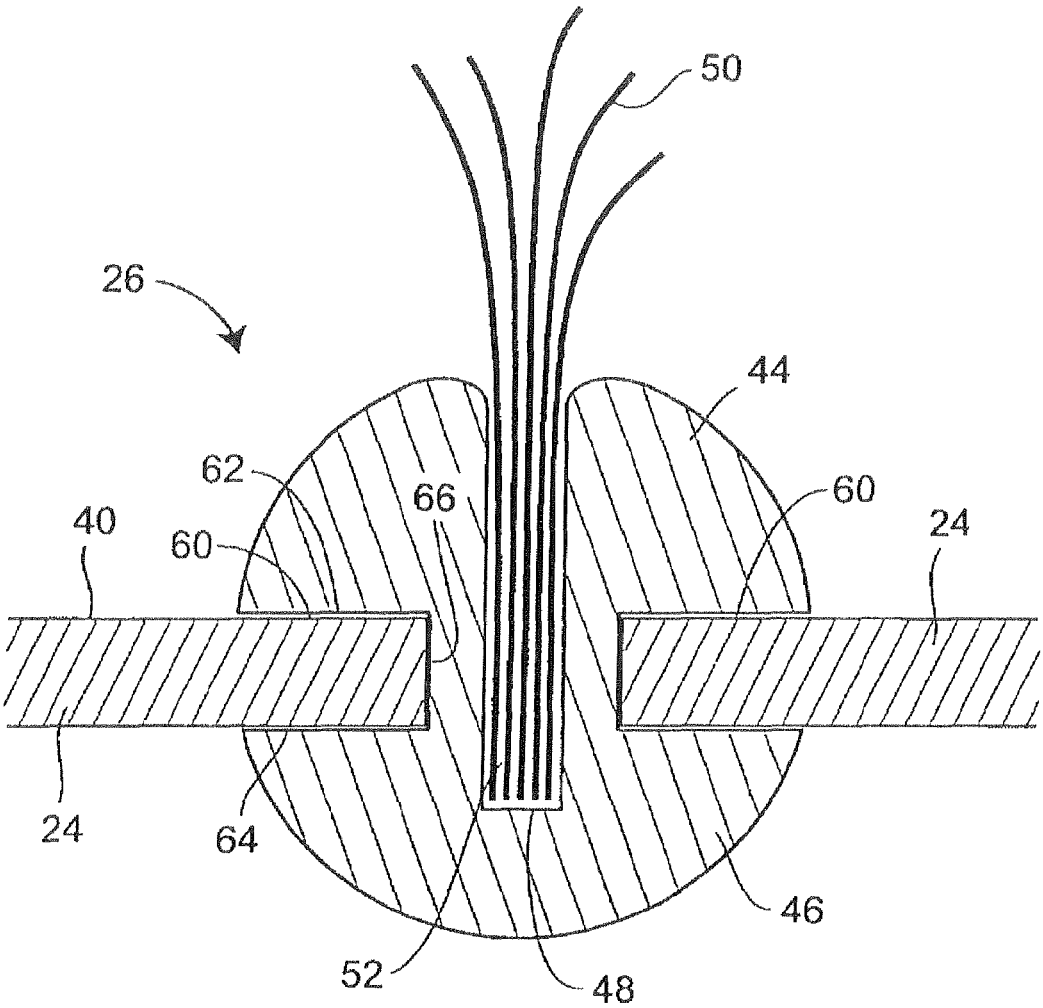
FIG. 7 is a cross-sectional view of one embodiment of a bristles anchor taken along line 7-7 of FIG. 3.

There are many other processes, however, that can accomplish disposing the bristle anchors 26 in the cushion pad 24. The bristle anchors 26 may include features that allow for a mechanical connection between the cushion pad 24 and the bristle anchors 26, such that the bristle anchors 26 may simply be snapped or pressed into an aperture of the cushion pad 24. For example, as seen in FIG. 7, the bristle anchors 26 may include an engagement member, such as the groove 60, to allow a mechanical connection of the bristle anchors 26 to the cushion pad 24. More specifically, the groove 60 may be disposed between the first end 44 and the second end 46 on the bristle anchor 26. The groove 60 may extend around the entire perimeter of the bristle anchor 26, around a portion of the perimeter, or may only exist in separate portions, such that the groove 60 is not contiguous. The groove 60 may include an upper surface 62, a lower surface 64, and an inner surface 66. The upper and lower surfaces 62, 64 may be oriented generally parallel to each other and define walls of the groove 60. The inner surface of the groove 60 is oriented generally perpendicular to the upper and lower surfaces 62, 64, and defines a bottom of the groove 60. It is, however, contemplated that the groove 60 can be other than rectangular or square in cross-section, and may be other shapes, including but not limited to, rounded, triangular, and semi-circular.

The grooves 60 may be created during the molding processes, or may be created in a separate machining operation. Regardless of the process in which the grooves 60 are created, the grooves 60 may be engaged with the cushion pad 24, and more specifically, may be engaged with the apertures 43 in the cushion pad 24.

The bristles 28 may be added to the bristle anchors 26 using several methods including, but not limited to, an automated Boucherie bristling machine known to those skilled in the art. In adding the bristles 28, apertures 48 are first created in the bristle anchors 26 either during or after the molding process and/or through a drilling operation. In the drilling operation, apertures 48 may be created in the bristle anchors 26 using a drill bit, or the like. A tuft of bristles 28 is then disposed in the aperture 48 of the bristle anchors 26 such that the second end 52 of the bristles 28 are located within the apertures 48. The tuft of bristles 28 can be forcibly inserted creating a tight tolerance fit in the apertures 48. To further secure the tuft of bristles 28 in the aperture 48, a metal staple, or other rigid dense object, may be disposed within the aperture 48 along with the bristles 28. The dense object may compress the second ends 52 of the bristles 28 in the aperture 48, such that the bristles are secured therein.

Many other tufting processes exist and are known in the art that can accomplish disposing the bristles 28 in the bristle anchors 26. For example, the bristles 28 can be manually placed within the aperture 48 such that no machine is required at all. Similarly, the bristles 28 may be added to the bristle anchors 26 during the molding or manufacturing process of the cushion pad 24 and/or the bristle anchors 26. The bristles 28 may also be disposed within the bristle anchors 26 without the use of the dense object. As such, the tight fit, i.e., the bristles being compressed in the aperture 48 of the bristle anchors 26, may be enough to retain the bristles 28 in the apertures 48 during use. Similarly, the bristles 28 may be glued, or otherwise anchored in the aperture 48.

Along with the above disclosed embodiments, the hair brush 20 and the cushion pads 24 may include initial and/or alternative features. For example, the cushion pad 24 need not be oval, but could be any shape desired, including round, square, triangular, or any other shape adaptable for the intended methods. Similarly, the bristle anchors 26 may be any shape able to accomplish the intended purpose. The bristles 28 also need not be poly-filament bristles 28, but could also be mono-filament bristles 28. The bristle anchors 26 are also not limited to the embodiment disclosed herein. For example, the bristle anchors 26 may have a cylindrical, triangular, square, circular or oval shape, or any other shape adaptable for the intended purpose. The aperture 48 in the bristle anchors 26 may also vary. For example, the aperture 48 need not be round, but could be square, oval, triangular, etc. Similarly, the aperture 48 may be through holes, blind holes, slots, or any other type of aperture able to receive the bristle 28.

The material from which the hair brush 20, the cushion pad 24, the bristle anchors 26, and the bristles 28 are constructed may also vary from the materials disclosed above. For example, the body 22 can be fabricated from relatively light weight, durable, and sturdy plastic materials such as polyethylene, polypropylene, polystyrene, or other suitable plastic materials. The body can also be wood, metal, or the like, or may not include the handle 34. Similarly, the body 22 can be injection molded, blow molded, continuously molded, extruded, vacuum formed, or the like. The manufacturing process or processes and materials can be selected based on feasibility, cost, tooling concerns, as well as other factors for a given application. The cushion pad 24 may be fabricated from relatively resilient and flexible materials such as rubber, fabric, plastic with high pliability, or plastic connected by joints to enable movement, paper-like material such as vellum, mylar, acetate, metal with high pliability in sheets or connected by joints, wooden pieces connected by joints to enable movement, or other suitable flexible material, or any material joined or designed to create flexible movement.

While the above has been described with reference to specific examples which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A method of bristle and cushion pad fabrication, comprising:

molding a plurality of substantially spherical bristle anchors from a first material;

forming a first aperture in each of the substantially spherical bristle anchors;

molding a cushion pad having a plurality of second apertures, an inner surface, and an outer surface, wherein the cushion pad is constructed from a second material;

securing the substantially spherical bristle anchors in the plurality of second apertures; and tufting a plurality of bristles in the first apertures.

2. The method of claim 1, wherein molding a plurality of substantially spherical bristle anchors includes molding a first portion and a second portion of the plurality of substantially spherical bristle anchors.

3. The method of claim 2, further including providing a groove on the substantially spherical bristle anchors between the first and second portions of the substantially spherical bristle anchors.

4. The method of claim 3, wherein the grooves are provided by molding the substantially spherical bristle anchors.

5. The method of claim 3, wherein the grooves are provided by machining the substantially spherical bristle anchors.

6. The method of claim 1, wherein the first apertures are provided by molding the substantially spherical bristle anchors.

7. The method of claim 1, wherein the first apertures are provided by drilling the substantially spherical bristle anchors.

8. The method of claim 1, further including adhering the bristles into the first apertures with adhesive.

9. The method of claim 1, further including forcing the plurality of bristles into the first apertures.

10. The method of claim 1, further including engaging the substantially spherical bristle anchors and the cushion pad.

11. The method of claim 10, wherein engaging the substantially spherical bristle anchors and the cushion pad further includes snapping the substantially spherical bristle anchors into the cushion pad.

12. The method of claim 1, wherein the step of molding the plurality of substantially spherical bristle anchors and the step of molding the cushion pad includes integrally molding the substantially spherical bristle anchors and the cushion pad together.

13. The method of claim 12, wherein the first material and the second material are different and selected for producing a covalent bond between the substantially spherical bristle anchors and the cushion pad when integrally molded together.

14. The method of claim 12, wherein the step of integrally molding the substantially spherical bristle anchors and the cushion pad together includes pre-forming the substantially spherical bristle anchors and molding the cushion pad around the pre-formed substantially spherical bristle anchors so that the substantially spherical bristle anchors are embedded securely in the cushion pad.

15. The method of claim 12, further comprising:

providing a body defining a rear cavity and a front face defining apertures; and positioning the cushion pad in the cavity with the substantially spherical bristle anchor apertures aligned with the front face apertures, wherein the step of tufting the bristles is performed after the cushion pad is positioned in the cavity and is performed so that the bristles extend from the substantially spherical bristle anchors and through the front face apertures and beyond.

16. The method of claim 12, wherein the first material that the substantially spherical bristle anchors are constructed from is a propylene material.

17. The method of claim 12, wherein the second material that the cushion pad is constructed from is a thermoplastic elastomeric material.

18. A bristle and cushion pad assembly fabricated by the method of claim 1.

19. A method of fabricating a hairbrush, comprising:

firstly molding a plurality of bristle anchors from a first material, wherein the bristle anchors each include a first end with a bristle aperture, a second end opposite the first end, and a groove between the first end and the second end; and secondly molding a cushion pad from a second material, wherein the cushion pad is integrally molded around the bristle anchors and into the grooves so that the bristle anchors are embedded securely in the cushion pad, wherein the first material and the second material are different and selected for producing a covalent bond between the bristle anchors and the cushion pad.

20. The method of claim 19, further comprising:

forming an aperture in each of the bristle anchors;

providing a body defining a rear cavity, a front face, and apertures through the front face;

positioning the cushion pad in the cavity with the bristle anchor apertures aligned with the front face apertures; and tufting the bristles so that they extend from the bristle anchors and through the front face apertures and beyond.

21. The method of claim 19, wherein the groove extends around an entire perimeter of the bristle anchor.

22. The method of claim 19, wherein the first material is a propylene material and the second material is thermoplastic elastomeric.

* * * * *